United States Patent [19]

Hauser

[11] Patent Number: 4,607,570

[45] Date of Patent: Aug. 26, 1986

[54] COMPRESSION EXTRACTOR

[75] Inventor: Hans-Ulrich Hauser, Niederweningen, Switzerland

[73] Assignee: Bucher-Guyer AG Maschinenfabrik, Niederweningen, Switzerland

[21] Appl. No.: 639,378

[22] Filed: Aug. 9, 1984

[30] Foreign Application Priority Data

Aug. 26, 1983 [CH] Switzerland ..... 4657/83

[51] Int. Cl.[4] ..... B30B 5/02

[52] U.S. Cl. ..... 100/116; 99/495; 100/211

[58] Field of Search ..... 100/211, 116, 117, 264, 100/107–110, 193, 202, 208, 234, 50; 210/350, 351; 99/495

[56] References Cited

U.S. PATENT DOCUMENTS

| | | | |
|---|---|---|---|
| 4,024,810 | 5/1977 | Braun | 100/116 |
| 4,106,404 | 8/1978 | Schmid | 100/211 X |
| 4,140,051 | 2/1979 | Hauser et al. | 100/116 |
| 4,151,795 | 5/1979 | Hauser | 100/211 X |
| 4,350,089 | 9/1982 | Braun | 100/116 |
| 4,387,634 | 6/1983 | Balass | 100/211 |

FOREIGN PATENT DOCUMENTS

| | | | |
|---|---|---|---|
| 2742517 | 4/1978 | Fed. Rep. of Germany | 100/211 |
| 2399913 | 4/1979 | France | 100/211 |

*Primary Examiner*—Timothy F. Simone

*Attorney, Agent, or Firm*—Marmorek Guttman & Rubenstein

[57] ABSTRACT

A compression extractor is disclosed. The compression extractor comprises a tank having a flexible membrane mounted therein. The membrane serves to divide the tank into a mash chamber and a pressure chamber. The mash chamber is adapted to receive a fruit mash or other liquid containing material from which liquid is to be extracted. When a pressure medium is introduced into the pressure chamber, the membrane presses on the mash in the mash chamber to extract the liquid therefrom. A liquid collection system is provided to collect the extracted liquid. To improve collection of the extracted liquid, the side of membrane facing the mash chamber is covered at least in part, with drainage canals or the like to direct liquid located near the membrane to the liquid collection system.

8 Claims, 7 Drawing Figures

COMPRESSION EXTRACTOR

FIELD OF INVENTION

This invention relates to compression extractors. More particularly, the invention relates to that type of extractor in which fluid pressure exerted against a flexible membrane compresses material located between the membrane and the wall of a tank to extract liquid from the material. Such compression extractors are useful for processing grape mash and the like.

BACKGROUND OF THE INVENTION

U.S. Pat. No. 2,538,403 discloses a compression extractor. This compression extractor comprises a lower tank portion and an upper tank portion, which together form a tank chamber. The upper tank portion has perforated walls and an opening for receiving the material from which liquid is to be extracted. Clamped between the upper tank portion and the lower tank portion is a pressure-actuated membrane. A pressure medium is introduced into the lower tank portion to compress the membrane against the material in the upper tank portion to extract the liquid therefrom. The liquid is collected from the upper tank portion through the perforations in the walls of the upper tank portion. The upper tank portion also includes means for discharging the leftover solid material remaining after the liquid has been extracted.

A second compression extractor is disclosed in German Pat. No. 2,456,247. This compression extractor includes a cylindrical tank which is divided by an elastic membrane into two chambers. Material, such as fruit mash, containing liquid to be extracted, is introduced into the first chamber. A pressure medium is introduced into the second chamber to press the membrane against the liquid containing material in the first chamber so as to extract the liquid therefrom. A liquid collection system is provided in the first chamber to remove the extracted liquid.

In both of the above-described compression extractors, extracted liquid located near the liquid collection system is satisfactorily removed from the compression extractor. However, extracted liquid located near the membrane is not satisfactorily removed from the extractor, as no means for carrying off the liquid is provided in this region and the essentially smooth membrane hinders drainage.

The object of the present invention is to create a device in which this defect is eliminated and which therefore enables more efficient deliquification of the mash.

SUMMARY OF THE INVENTION

In a preferred embodiment, the compression extractor of the present invention comprises an elongated tank. A flexible membrane extends longitudinally within the tank for dividing the tank into a pressure chamber and a mash chamber. The rim of the membrane is mounted to the inner wall of the tank. The mash chamber includes an opening for introducing therein liquid containing material such as grape mash or the like. The pressure chamber includes an opening for introducing therein a pressure medium which exerts pressure on the membrane, thereby pressing the membrane against the mash in the mash chamber to extract the liquid contained therein. The mash chamber is coupled to a liquid collection system for collecting the liquid squeezed from the mash. Typically, the liquid collection system includes one or more drain pipes running longitudinally along the interior wall of the tank.

To enhance the deliquification of those portions of the mash located near the membrane, the side of the membrane facing the mash chamber includes drainage means disposed thereon for conveying the extracted liquid in the region adjacent the membrane towards the liquid collection system. Preferably the drainage means comprises one or more flute-shaped drainage canals, which canals carry the extracted liquid toward the liquid collection system. In a particular embodiment of the invention, such drainage canals may be formed on the entire surface of the membrane, so that the entire membrane surface facing the mash chamber serves to enhance deliquification.

Alternatively, instead of drainage canals, knob-like protruding elevations, such as those comprising a carpet, may be formed on the membrane surface to enhance drainage. The drainage means can, in some cases, be formed from cord-like elements. Such a construction is especially effective, if the cord-like elements lie relatively close to one another so that drainage canals are formed therebetween.

To still further enhance deliquification of those regions of the mash located near the membrane, a flap may extend from the rim of the membrane toward the drain pipes comprising the liquid colection system. Such a flap would include the above-mentioned drainage canals or the like for conducting extracted liquid to the drain pipes comprising the liquid collection system.

DETAILED DESCRIPTION OF THE INVENTION

Figure 1:
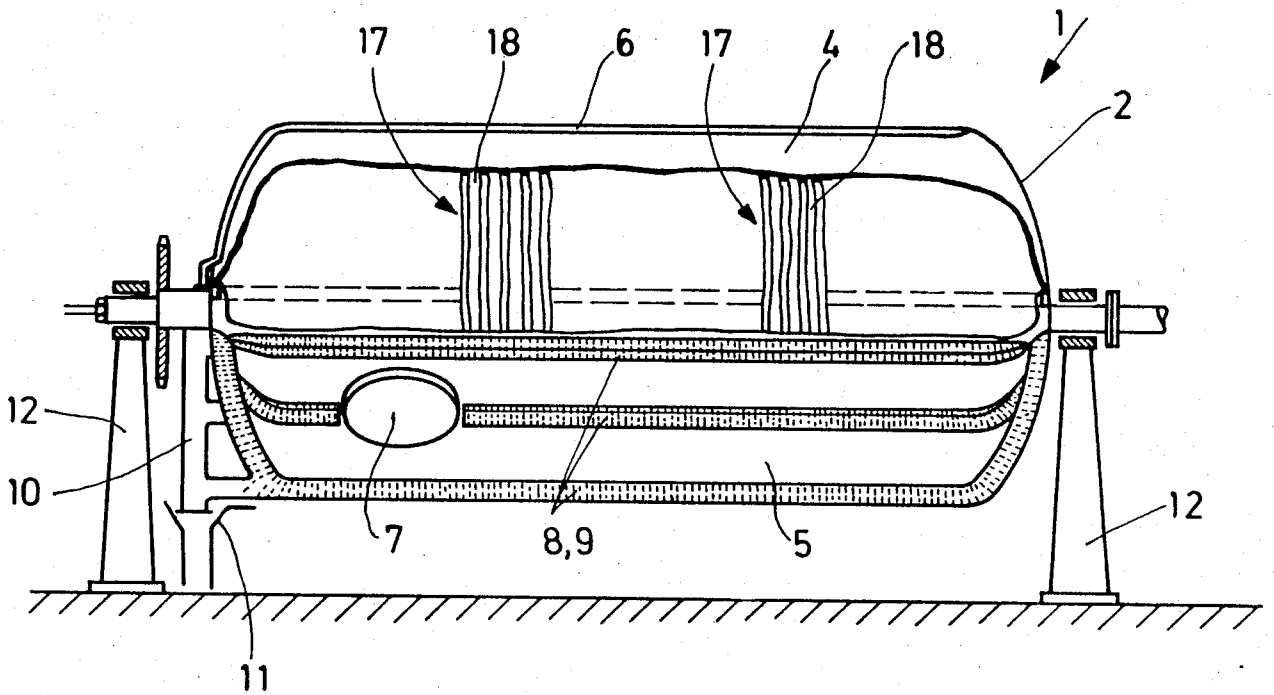
FIG. 1 shows a longitudinal section of a compression extractor in accordance with an illustrative embodiment of the invention.
Figure 2:
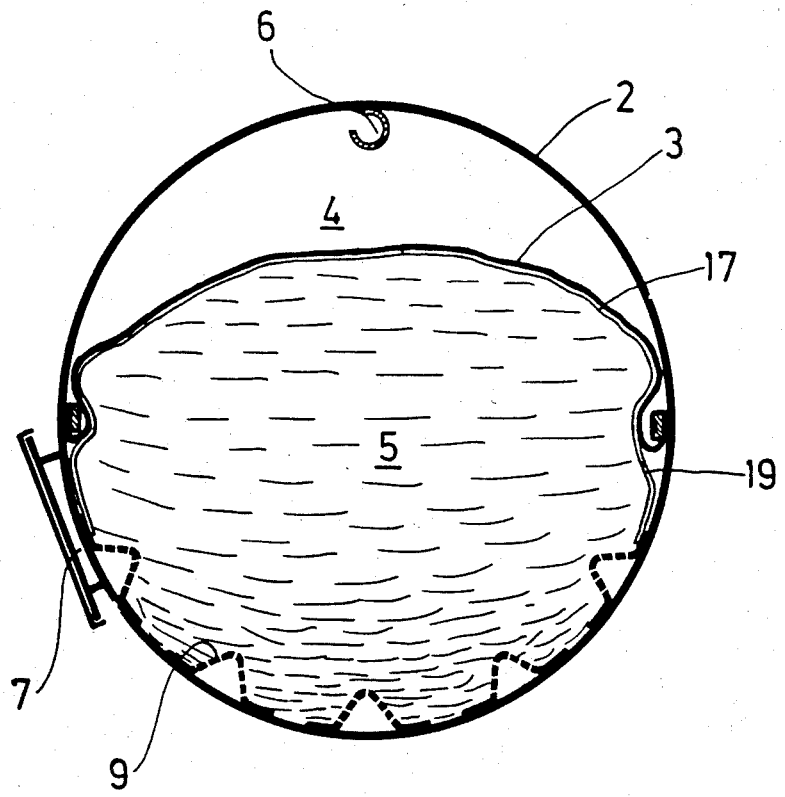
FIG. 2 shows a cross-sectional view of the compression extractor of FIG. 1.

Referring to FIGS. 1 and 2, compression extractor 1 comprises a generally cylindrical tank 2, the interior of which is divided by a longitudinally extending flexible bag-like membrane 3 into a pressure chamber 4 and a mash chamber 5. The pressure chamber 4 is provided with an entry device 6 for enabling a pressure medium to be introduced into and removed from the pressure chamber 4. The mash chamber 5 has a filling and discharge opening 7 through which the mash or other liquid containing material is introduced into the chamber 5 and through which residual solid material is removed after the liquid is extracted. When a pressure medium is introduced into the pressure chamber 4, the membrane 3 presses against the mash in the mash chamber 5 to extract the liquid therefrom.

The tank 2 is rotatably supported for rotation about a horizontal axis by support frames 12. A motor (not shown) is used to rotate the tank 2. When mash is being fed into the mash chamber 5, it is desirable that the tank 2 be rotated so that the opening 7 is located near the top of the tank 2. Similarly, when residual material is being removed from the mash chamber 5, it is desirable that the tank 2 be rotated so that the opening 7 is located near the bottom of tank 2.

The mash chamber 5 also includes an arrangement 8 for collecting the squeezed-out liquid. A plurality of drainage pipes 9 run along the inner wall of the mash chamber 5. The drainage pipes 9 are provided with perforations 90 through which the extracted liquid passes. The extracted liquid flows along the drainage elements 9 onto a collecting space 10 mounted on the outer surface of tank 2. The extracted liquid leaves the compression extractor 1 by way of collecting cone 11.

Figure 3:
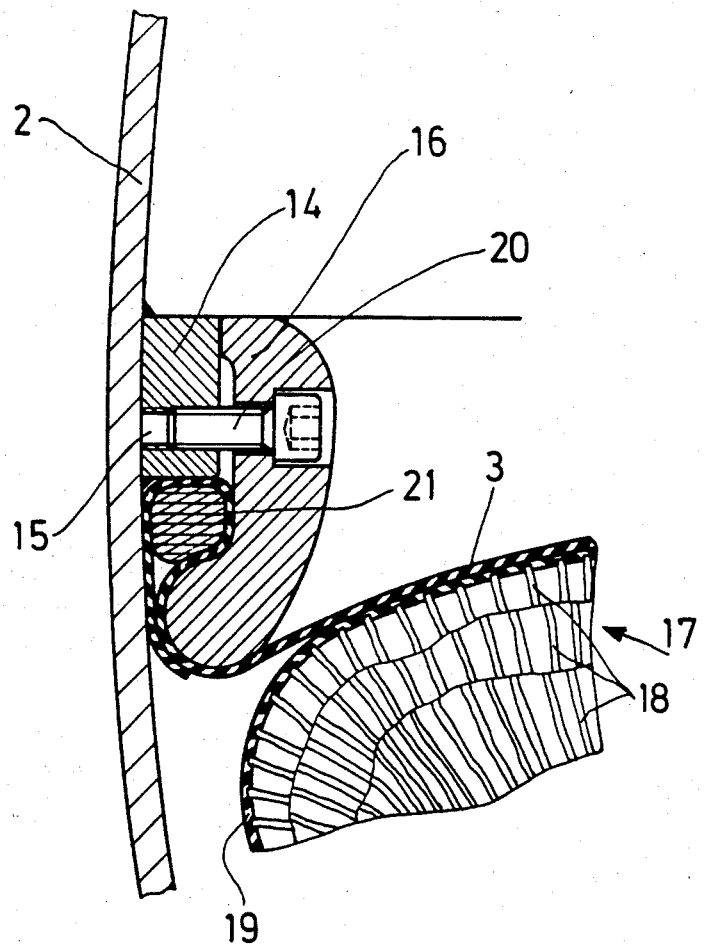
FIG. 3 illustrates how the membrane is mounted to the tank portion of the extractor of FIG. 1.

The membrane 3 is mounted by way of support structure 13 to the inner wall of the tank 2. FIG. 3 shows in more detail how the membrane 3 is mounted to the tank 2. The membrane 3 is folded about excess sealing strip 21 which extends along the inner wall of tank 2. Connecting strip 16 secures the folded portion of the membrane 3 and the sealing strip 21 underneath the ledge 14, which ledge is mounted to the inner wall of tank 2 in a plane approximately parallel to the rotational axis of the tank 2. Connecting strip 16 is secured to the ledge 14 by way of screws 20 which are received in holes 15.

While the liquid collecting arrangement 8 is satisfactory for collecting extracted liquid located near the drain pipes 9, the collecting arrangement 8 does not satisfactorily collect extracted liquid located near the membrane 3. To effect drainage of the portion of the mash located near the membrane 3, the membrane 3 is provided on the side facing the mash, with drainage device 17. The drainage device 17 comprises a plurality of flute-type drainage canals 18 which extend toward the drain pipes 9. These drainage canals 18 are ideally 3–4 mm wide and are of about the same depth. The canals 18 may—as shown in FIG. 1—be arranged in the form of sections which cover selected portions of the membrane 3. Alternatively, as shown in FIG. 3, the flute-type canals 18 may cover the entire membrane 3. The canals 18 are used to conduct extracted liquid located near the membrane 3 to the drain pipes 9.

Figure 4:
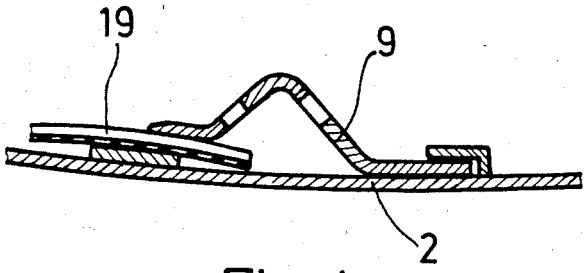
FIG. 4 is an enlarged view of a portion of the liquid collection system of the extractor shown in FIG. 1.

To improve the conduction of extracted liquid to the drainage elements 9, the rim 25 of the membrane 3 is provided with a flap 19 that extends to the outermost of the drain pipes 9. The flap 19 is used to lengthen the drainage device 17. As shown in FIG. 4, the free end of the flap 19 is connected to the outermost of the drain pipes 9 so that transfer of the liquid extracted from the mash to the liquid collection arrangement 8 is enhanced.

Figure 5:
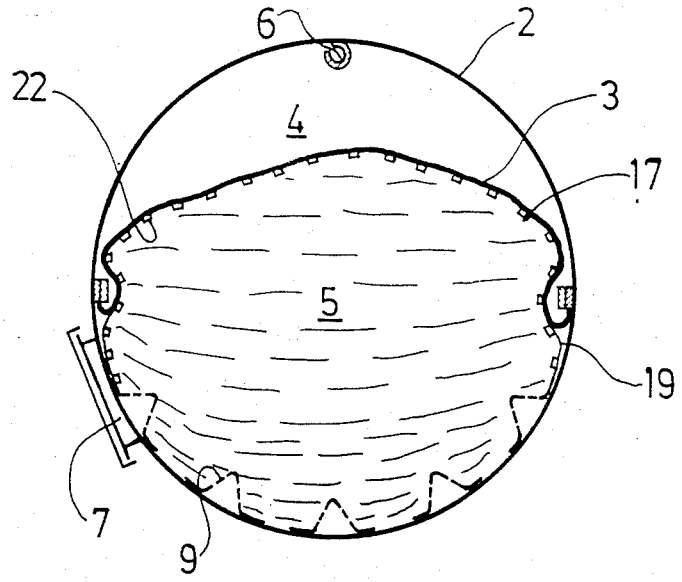
FIG. 5 shows a cross-sectional view of another embodiment of the compression extractor of the present invention.
Figure 6:
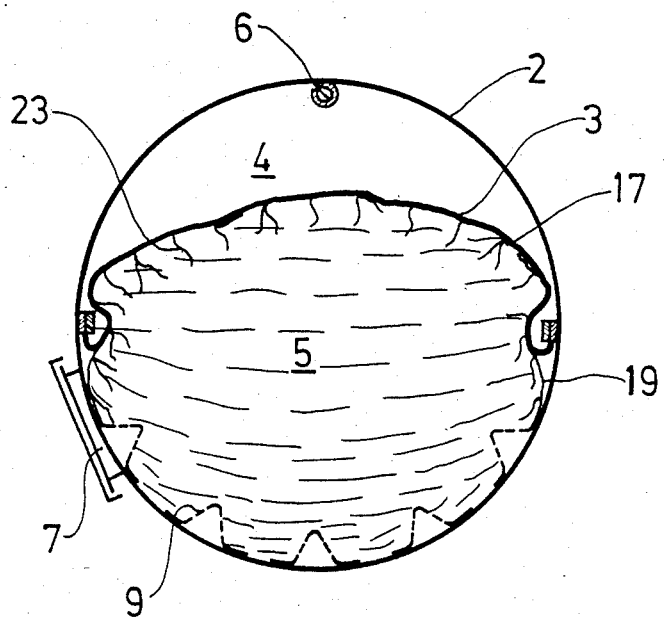
FIG. 6 is a cross-sectional view of another embodiment of the compression extractor of the present invention.
Figure 7:
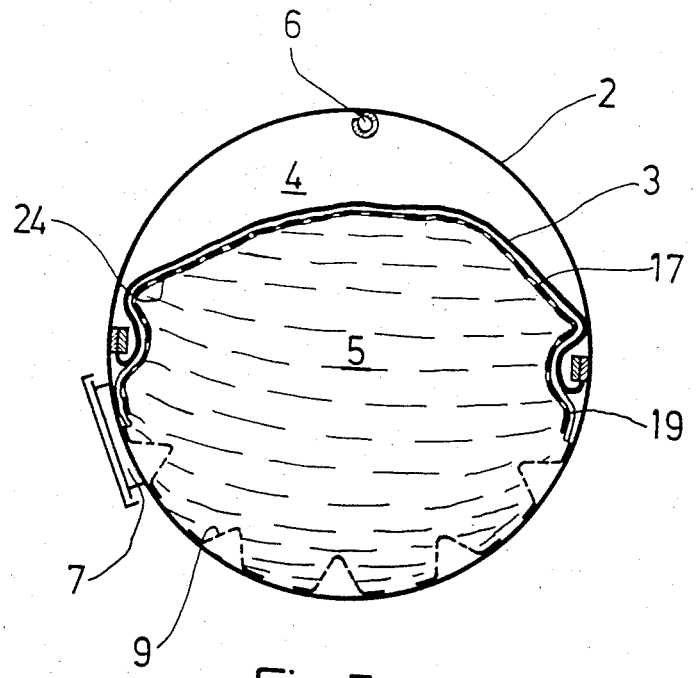
FIG. 7 shows a cross-sectional view of yet another embodiment of the compression extractor of the present invention.

Instead of flute-like drainage canals, the side of the membrane 3 facing the mash may be covered with protrusions or nub-like projections, which are shown as numeral 22 in FIG. 5, of the type which are used to form a carpet. Alternatively, cord-like elements which are shown by the numeral 23 in FIG. 6 may be positioned next to one another to form drainage canals on the side of the membrane 3 facing mash. In some cases, such as when the mash comprises certain types of grapes which are difficult to compress, the drainage device 17 may be covered with a filter net or web 24 (FIG. 7). The net or web serves to protect the drainage means 17 from non-liquid matter.

Finally, the above described embodiments of the invention are intended to be illustrative only. Numerous alternative embodiments of the invention may be devised by those skilled in the art without departing from the spirit and scope of the claims which follow.

I claim:

1. A compression extractor for use in extracting liquid from a liquid containing material, said compression extractor comprising:
   (a) a tank,
   (b) membrane means mounted in said tank for dividing said tank into a pressure chamber and a mash chamber said membrane means having a surface facing said mash chamber,
   (d) means for introducing a pressure medium into said pressure chamber so as to cause said membrane means to press against said liquid containing material in said mash chamber thereby extracting said liquid therefrom,
   (e) liquid collection means coupled to said mash chamber for collecting said extracted liquid; and
   (f) draining path defining means incorporated on at least a portion of said surface of said membrane means facing said mash chamber for conveying said extracted liquid toward said liquid collection means.

2. The Compression extractor of claim 1, wherein said drainage path defining means comprises a plurality of grooved drainage canals formed on said surface of said membrane means facing said mash chamber and oriented towards said liquid collection means for conveying said extracted liquid to said liquid collection means.

3. The compression extractor of claim 1, wherein said drainage path defining means comprises a multiplicity of nub-like projections formed on said surface of said membrane means facing said mash chamber.

4. The compression extractor of claim 1, wherein said drainage path defining means comprises a plurality of cord-like elements formed on the surface of said membrane means facing said mash chamber.

5. The compression extractor of claim 4, wherein the cord-like elements are spaced apart from each other.

6. The compression extractor of claim 1, wherein said compression extractor includes filter means placed for protecting said drainage path defining means from non-liquid matter.

7. The compression extractor of claim 1, wherein said membrane means has a flap connected thereto, said flap extending towards said liquid collection means.

8. The compression extractor of claim 1, wherein a filter net is arranged over said drainage means in order to improve drainage of said liquid from said liquid-containing matter.

* * * * *